US005580061A

United States Patent [19]

Kong

[11] Patent Number: 5,580,061

[45] Date of Patent: Dec. 3, 1996

[54] METHOD OF PLAYING PAI GOW BY ELIMINATING PUSHES

[76] Inventor: Yu W. Kong, 6288 Pride La., Las Vegas, Nev. 89103

[21] Appl. No.: 536,933

[22] Filed: Sep. 29, 1995

Related U.S. Application Data

[63] Continuation-in-part of Ser. No. 312,514, Sep. 26, 1994, abandoned.

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS 4,909,513 3/1990 Kiyono ..... 273/145 R 5,224,706 7/1993 Bridgeman et al. ..... 273/85 CP 5,259,618 11/1993 Ramos ..... 273/145 C 5,350,175 9/1994 DiLullo et al. ..... 273/274

OTHER PUBLICATIONS

Win Magazine, Pai Gow Poker by Linya Quan, pp. 39, 40 and 70, Apr. 1992.

*Primary Examiner*—Benjamin H. Layno

*Attorney, Agent, or Firm*—Quirk & Tratos

[57] ABSTRACT

A push in a game of Pai Gow Poker is eliminated by determining whether or not corresponding predetermined entities in a banker's holding and a player's holding have numerical values that are either both odd or both even.

10 Claims, No Drawings

METHOD OF PLAYING PAI GOW BY ELIMINATING PUSHES

RELATED PATENT APPLICATIONS

This application is a continuation-in-part of U.S. patent application Ser. No. 08/312,514 filed Sep. 26, 1994 now abandoned.

BACKGROUND OF THE INVENTION

1. Field of Invention

This invention is in the general field of games of chance and, more particularly is an improvement in the game of Pai Gow Poker.

2. Description of the Prior Art

The game of Pai Gow Poker, sometimes called Asian Poker, is a relatively new type of poker game that has gained acceptance by casinos at almost all major gambling centers. The game is played with a single standard deck of 52 playing cards plus a Joker. The Joker can only be used to represent an Ace or to represent one card of either a straight or a flush. Rankings, including straights and flushes, are explained hereinafter.

The game is started by dealing seven cards to each of six player positions and a banker's position. A player forms two hands from his holding of seven dealt cards. One hand, called a Low Hand, consists of two of the dealt cards. The other hand, called a High Hand consists of the remaining five dealt cards. In a similar manner, the banker forms a High Hand and a Low Hand from his seven card holding. The only requirement in forming the hands is that the Low Hand must be of a lower rank than the High Hand.

When the player forms his Low Hand and his High Hand so that they are respectively higher in rank than a Low Hand and a High Hand of the banker, the player is a winner and the banker is a loser. Conversely, when the player forms his Low Hand and his High Hand so that they are respectively lower in rank than a Low Hand and a High Hand of the banker, the player is a loser and the banker is a winner. When one of the player's hands is of the same rank as a corresponding one of the banker's hands, the banker's hand is deemed to be of higher rank than the player's hand.

When the player's Low Hand is of a higher rank than the banker's Low Hand and the player's High Hand is of lower rank than the banker's High Hand what is known as a push exists. Similarly, the push exists when the player's Low Hand is of a lower rank than the banker's Low Hand and the player's High Hand is of higher rank than the banker's High Hand. When the push exists, there is no winner.

A determination of a winner correspondingly determines the outcome of a wager between the player and the banker. Hence, wagers are neither won nor lost when the push exists.

It should be understood that in a casino where the game is played, a dealer employed by the casino usually takes a five percent commission from wagers that are won. Since no wagers are won when the push exists, the push is an undesirable non-revenue producing use of the casino's resources.

The rankings of hands in Pai Gow Poker is similar to the rankings of hands in the more common forms of stud poker. Accordingly, since the Low Hand consists of two cards, its highest rank is a pair of Aces. It should be understood that the Joker may be used to represent an Ace in the Low and High Hands. Rankings of the High Hand are as follows:

FIVE ACES, highest ranking hand (formed by four Aces and the Joker);

ROYAL FLUSH, (Ace, King, Queen, Jack, and 10 of the same suit);

STRAIGHT FLUSH, ( A straight in any suit, i.e., Jack, 10, 9, 8, 7 of the same suit);

FOUR OF A KIND, (Four Aces is highest);

FULL HOUSE, (THREE OF A KIND plus a PAIR, i.e., Ten, Ten, Ten, King, King);

FLUSH (Five cards of the same suit);

STRAIGHT (Five cards in sequence but of different suits, i.e., Jack, 10, 9, 8, 7);

THREE OF A KIND (Three cards of the same rank, i.e., three Aces)

TWO PAIRS (i.e., two Kings and two 10's)

ONE PAIR (Two cards of the same rank. Two aces is the highest pair and two 2's is the lowest pair)

NO PAIR (Ace, King is the highest Low Hand of this kind)

It should be understood that the Joker may be used to represent one of the cards of a royal flush, a straight flush, a flush and a straight.

Since the existence of the push is a non-revenue producing use of the casino's resources, it is desirable to eliminate the push, thereby causing either the banker or the player to be a winner.

SUMMARY OF THE INVENTION

An object of the present invention is to eliminate a non-revenue producing use of a casino's resources.

According to the present invention, a push in a game of Pai Gow Poker is eliminated by assigning a numerical value to each card and determining whether corresponding cards in a banker's holding and a player's holding have numerical values that are either both odd or both even. When the values are either both odd or both even, the player (or banker) is a winner. When the values are neither both odd nor both even, the banker (or player) is a winner.

When a push occurs in a game of Pai Gow Poker played in a casino, the present invention may be utilized to rapidly eliminate the push, thereby reducing a non-revenue producing use of the casino's resources.

Other objects, features, and advantages of the invention will be apparent from the following description of embodiments of the present invention.

DESCRIPTION OF THE EMBODIMENTS

As explained hereinbefore, the game of Pai Gow Poker is played with a standard deck of 52 playing cards plus a Joker. Seven cards are dealt to each of six player positions and a banker's position. A player and the banker each form a low hand consisting of two of their seven cards and a high hand consisting of their remaining five cards. The player (or the banker) wins when the player's (or the banker's) low hand and high hand are of higher rank than the banker's (or the player's) low hand and high hand respectively.

As a first example, when the player has low and high hands consist of Five, Five (a pair of Fives) and Jack, Jack, Seven, Four, Three (a pair of Jacks), respectively, and the banker has low and high hands consist of Six, Six (a pair of Sixes) and Ten, Ten, Ace, Seven, Two (a pair of Tens), respectively, a push exists.

As a second example, the push exists when the player's low and high hands consist of a pair of Fours and a pair of Queens, respectively, and the banker's low and high hands consist of a pair of Sixes and a pair of Tens, respectively. The push is eliminated as described hereinafter.

In each of the embodiments, an added feature of the game is the cards being assigned a numerical value. The Jacks, Queens Kings and the Joker of the deck may carry an indicia indicating their respective numerical values.

In one specific embodiment, Aces are assigned the numerical value of one; Twos, Threes, Fours, Fives, Sixes, Sevens, Eights, Nines and Tens are assigned numerical values equal to their nominal values; Jacks, Queens and Kings are assigned the numerical values of eleven, twelve, and thirteen, respectively, and the Joker is assigned the numerical value of fourteen. In an alternative embodiment, the Joker is assigned the numerical value of fifteen.

When a push exists, the cards of lowest numerical value in the player's Low Hand and the bankers Low Hand are compared in an odd/even comparison. When both of the compared cards are of either odd or even numerical value, the player is a winner. Conversely, when one of the compared cards is of odd numerical value and the other is of even numerical value, the banker is a winner. Therefore, in the first example the banker is a winner. In the second example the player is a winner.

In an alternative embodiment, the cards of highest numerical value in the Low Hands are compared in the odd/even comparison.

In another alternative embodiment, respective sums of the numerical values of the cards in the player's Low Hand and the banker's Low Hand are compared in the odd/even comparison.

In other alternative embodiments, the odd/even comparison is used to compare either numerical values of cards or the sum of numerical values of cards in the players's High Hand to those in the banker's High Hand.

While the invention has been particularly shown and described with reference to a preferred embodiment thereof, it should be understood by those skilled in the art that changes in form and detail may be made therein without departing from the spirit and scope of the invention.

I claim:

1. In the method of eliminating a push in a game of Pai Gow Poker where a player and a banker are each dealt seven cards from a standard deck of 52 playing cards plus a Joker, the player and the banker each forming a High Hand and a Low hand from the dealt cards, the steps of:

assigning a numerical value to each card;

comparing a card in a player's hand to a corresponding card in a banker's hand; and designating a winner based upon whether or not the corresponding cards have numerical values that are either both odd or both even.

2. The method of claim 1 wherein said step of assigning includes assigning an odd numerical value to the Joker, Aces, Threes, Fives, Sevens, Nines, Jacks and Kings, with all other cards being assigned an even numerical value.

3. The method of claim 1 wherein said step of assigning includes assigning an odd numerical value to the Aces, Threes, Fives, Sevens, Nines, Jacks and Kings, with all other cards being assigned an even numerical value.

4. The method of claim 1 wherein said corresponding cards are the cards of lowest numerical value in the player's Low Hand and the banker's Low Hand.

5. The method of claim 1 wherein said corresponding cards are the cards of highest numerical value in the players Low Hand and the banker's Low Hand.

6. The method of claim 1 wherein said step of assigning includes assigning an odd numerical value to the Aces, Threes, Fives, Sevens, Nines, Jacks and Kings, with all other cards being assigned an even numerical value.

7. In the method of eliminating a push in a game of Pai Gow Poker where a player and a banker are each dealt seven cards from a standard deck of 52 playing cards plus a Joker, the player and the banker each forming a High Hand and a Low hand from the dealt cards, the steps of:

assigning a numerical value to each card;

comparing one of the player's hands to a corresponding one of the banker's hands; and designating a winner based upon whether or not the sums of the numerical values of the cards in the corresponding hands are either both even or both odd.

8. In the method of claim 7 wherein the corresponding hands are the player's low hand and the banker's low hand.

9. In the method of claim 7 wherein the corresponding hands are the player's high hand and the banker's high hand.

10. The method of claim 7 wherein said step of assigning includes assigning an odd numerical value to the Joker, Aces, Threes, Fives, Sevens, Nines, Jacks and Kings, with all other cards being assigned an even numerical value.

* * * * *